US009728843B2

(12) United States Patent
Hunter et al.

(10) Patent No.: US 9,728,843 B2
(45) Date of Patent: Aug. 8, 2017

(54) CONFORMABLE ANTENNA USING CONDUCTING POLYMERS

(71) Applicant: Massachusetts Institute of Technology, Cambridge, MA (US)

(72) Inventors: Ian W. Hunter, Lincoln, MA (US); Lauren Montemayor, San Antonio, TX (US); Eli Travis Paster, Cambridge, MA (US); Priam Pillai, Pleasant Hill, CA (US); Bryan P. Ruddy, Auckland (NZ)

(73) Assignee: MASSACHUSETTS INSTITUTE OF TECHNOLOGY, Cambridge, MA (US)

( * ) Notice: Subject to any disclaimer, the term of this patent is extended or adjusted under 35 U.S.C. 154(b) by 548 days.

(21) Appl. No.: 13/766,199

(22) Filed: Feb. 13, 2013

(65) Prior Publication Data

US 2014/0028508 A1 Jan. 30, 2014

Related U.S. Application Data

(63) Continuation of application No. PCT/US2011/045743, filed on Jul. 28, 2011.

(60) Provisional application No. 61/373,343, filed on Aug. 13, 2010.

(51) Int. Cl.

| | |
|---|---|
| ***H01Q 1/27*** | (2006.01) |
| ***H01B 1/12*** | (2006.01) |
| ***H01Q 1/36*** | (2006.01) |
| ***H01Q 1/38*** | (2006.01) |
| ***H01Q 9/04*** | (2006.01) |

(52) U.S. Cl.
CPC ..... *H01Q 1/273* (2013.01); *H01B 1/127* (2013.01); *H01Q 1/364* (2013.01); *H01Q 1/38* (2013.01); *H01Q 9/0407* (2013.01); *Y10T 29/49016* (2015.01)

(58) Field of Classification Search
CPC ..... H01B 1/127; H01Q 1/273; H01Q 1/38; H01Q 9/0407; H01Q 1/364
USPC ..... 343/718, 873, 897
See application file for complete search history.

(56) References Cited

U.S. PATENT DOCUMENTS

| | | | | |
|---|---|---|---|---|
| 5,423,956 A * | 6/1995 | White et al. | ..... | 205/414 |
| 5,448,256 A * | 9/1995 | Ohashi | ..... | H01Q 1/14 343/878 |
| 6,483,469 B2 * | 11/2002 | Boyle | ..... | 343/718 |
| 6,867,740 B2 * | 3/2005 | Goodyear | ..... | 343/718 |

(Continued)

FOREIGN PATENT DOCUMENTS

| | | |
|---|---|---|
| EP | 2148388 A1 | 1/2010 |
| WO | 2009005271 A2 | 1/2009 |

OTHER PUBLICATIONS

International Search Report and Written Opinion issued in connection with PCT Application No. PCT/US2011/045743, mailed on Dec. 19, 2011.

(Continued)

*Primary Examiner* — Jessica Han
*Assistant Examiner* — Michael Bouizza
(74) *Attorney, Agent, or Firm* — Gesmer Updegrove LLP

(57) ABSTRACT

Antenna including a wire made of a conducting polymer. The wire is sewn into fabric material in a selected pattern. A preferred conducing polymer is polypyrrole. It is also preferred that the wire be encased in a non-conductive, low dielectric plastic.

7 Claims, 1 Drawing Sheet

(56) References Cited

U.S. PATENT DOCUMENTS

| | | | | |
|---|---|---|---|---|
| 7,425,922 | B1 * | 9/2008 | Adams | 343/700 MS |
| 2006/0125707 | A1 | 6/2006 | Waschenko | |
| 2011/0122323 | A1 * | 5/2011 | Kim | 348/739 |

OTHER PUBLICATIONS

International Preliminary Report on Patentability issued in connection with the corresponding PCT Application No. PCT/US2011/045743, issued on Feb. 28, 2013.

* cited by examiner

CONFORMABLE ANTENNA USING CONDUCTING POLYMERS

PRIORITY INFORMATION

The present application is a continuation of PCT application No. PCT/US2011/045743, filed on Jul. 28, 2011, that claims priority to U.S. Provisional Application Ser. No. U.S. 61/373,343, filed on Aug. 13, 2010, both of which are incorporated herein by reference in their entireties.

SPONSORSHIP INFORMATION

This invention was made with government support under Contract No. D11PC75421 awarded by the Department of Interior and under Contract No. W911NF-07D-0004 awarded by the Army Research Office. The government has certain rights in this invention.

BACKGROUND OF THE INVENTION

This invention relates to antennas and more particularly to a conformable antenna made from a conducting polymer.

Soldiers performing dismounted operations in the field use radios that have antennas with a distinct visual signature and thereby become easy targets. Such antennas also tend to snag on other equipment or vegetation creating a hazard and a distraction to an ongoing operation. Therefore, it has become desirable to develop an antenna that can conform to soldiers and be virtually indistinguishable from a soldier's body armor. Traditional antennas are made of materials such as metals that tend to break under repeated cycles of loading and unloading which therefore makes them undesirable for such field operations.

It is therefore an object of the present invention to create patch antennas made from conducting polymers that can easily conform to a soldier's body and can match the performance of existing antennas.

SUMMARY OF THE INVENTION

In a first aspect, the invention is an antenna including a wire made of a conducting polymer, the wire sewn into, or adhered onto, fabric material in a selected pattern. In a preferred embodiment, the conducting polymer is polypyrrole (PPy). It is preferred that the wire be encased in a non-conductive, low dielectric plastic. It is also preferred that the fabric material include a hook-and-loop portion for attachment to another object such as an article of clothing. In this embodiment, the antenna further includes a connector for connecting the wire to a proximal end of a coaxial cable. A distal end of the coaxial cable preferably includes a connector for interface with a radio device.

In another embodiment of this aspect of the invention, the fabric material with the embedded antenna is enclosed in a weather-proof casing. It is also preferred that the proximal end of the coaxial cable be strain relieved within the fabric material.

In yet another aspect, the invention is a method of making a conductive polymer wire including growing a thin film of conductive polymer on a crucible and slicing the polymer in a helical pattern to form a wire with a selected width.

DESCRIPTION OF THE PREFERRED EMBODIMENT

Conducting polymers are electrically conducting materials that have high electrical conductivities (~$10^4$ S/m) and are extremely lightweight and flexible. Wires synthesized from such conducting polymers have a wide range of applications that can include smart textiles, neural probes, polymer based actuators, sensors and antennas. Electrochemically deposited thin films of polypyrrole (PPy) are an attractive conducting polymer due to their robust mechanical properties and high electrical conductivity. Disclosed herein is a novel polymer based patch antenna that can easily be adapted to conform to a soldier's body and we have conducted preliminary tests to assess the feasibility of the use of such polymer wires as an antenna.

Polypyrrole films cannot be synthesized as long wires using traditional electrospinning or wet spinning techniques. The inventors herein have developed a novel approach to manufacture wires of polypyrrole up to four meters long and having a cross section of 20 μm×1000 μm. We have grown polypyrrole on a crucible and used a tool that slices the film in a helical pattern by running a sharp blade over the polypyrrole film on the crucible. It is preferred that the blade be simultaneously slid along its length such that a fresh cutting edge is continuously presented at the point of contact with the crucible. We have produced polypyrrole microwires with widths as small as a few micrometers and lengths ranging from tens of millimeters to meters.

In one example, a strip of polypyrrole 4 meters in length was cut using the technique described above. The polypyrrole wire was then encased in a non-conductive, low dielectric plastic in order to protect it. A suitable plastic material is Mylar, polyvinyl chloride, polyvinylidene chloride, low density polyethylene, poly (p-xylylene) and derivatives (parylene). The resulting material was then sewn into a camouflage material.

Figure 1A:
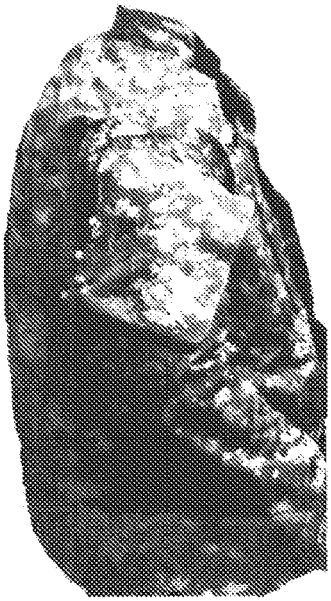
FIGS. 1*a*, 1*b*, and 1*c* are perspective views of the antenna disclosed herein sewn into fabric and applied to an article of clothing.
Figure 1B:
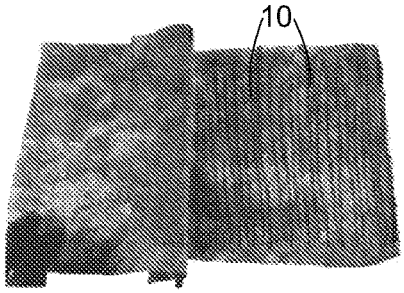
Figure 1C:
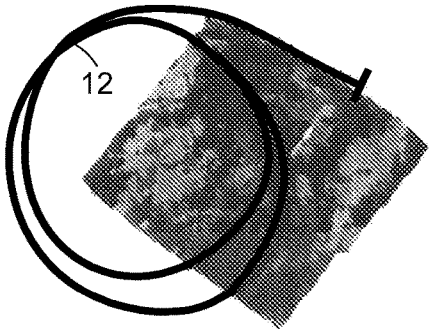

With reference now to FIG. 1, polypyrrole wire 10 is sewn back-and-forth into camouflage material as shown in FIG. 1*b*. The polymer wire 10 was then connected to a coaxial cable 12 as shown in FIG. 1*c* using a custom built connecter that was also sewn into the fabric. The other end of the coaxial cable 12 was connected to a BNC connector. It is preferred that the connecting wire be strain relieved within the fabric itself to provide additional robustness. As shown in FIG. 1*a*, the patch antenna including the polypyrrole wire 10 may be attached to the shoulder of a uniform using hook-and-loop material such as Velcro.

Figure 2A:
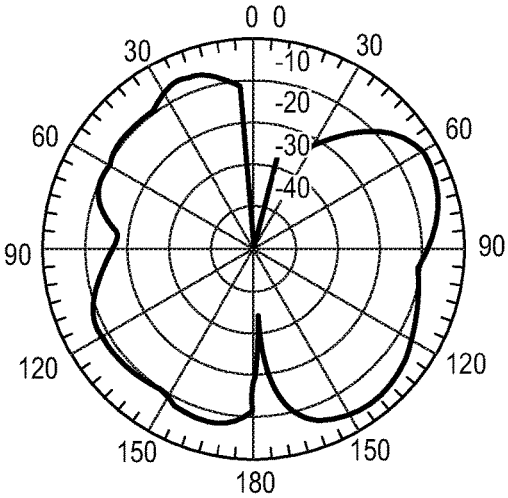
FIGS. 2*a* and 2*b* are polar graphs of degrees compared to realized gain dBi for 250 MHz and 500 MHz of a conformal antenna made from the conducting polymer polypyrrole.
Figure 2B:
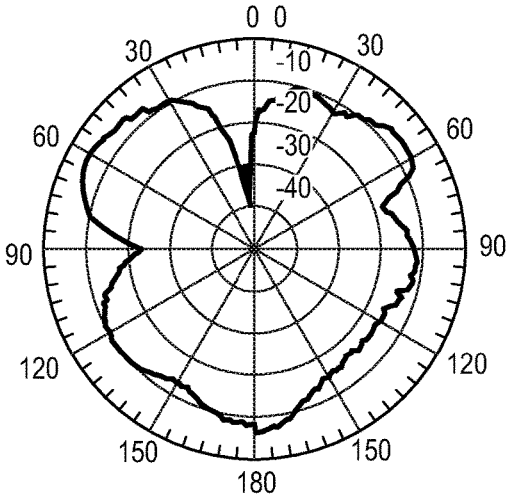

We conducted a preliminary analysis to assess the effectiveness of the polymer material as an antenna. FIGS. 2*a* and 2*b* show a plot of 250 and 500 MHz gain of a helically wound PPy strip relative to a black base. We observed a −10 dBi attenuation at those frequencies for the PPy strip in that geometry. We also tested the antenna using commercially available radios and were able to demonstrate transmission and reception over a 1.7 mile radius within an urban environment.

The antenna disclosed herein is light in weight (250 mg), flexible and conformable. The antenna can be embedded into uniforms, equipment or structured armor. The polypyrrole material may be grown in batches of 30 feet by 0.04 inches. Robotic instrumentation may be used for wire slicing and removal. It is also preferred that vacuum sealing be used to make the antenna waterproof. Those of ordinary skill in the art will recognize that impedance matching between the antenna and existing radios to improve efficiency may be provided.

The antenna disclosed herein provides weight reduction by a factor of 500 and volume reduction by a factor of 15 or greater when compared with a standard, 1 meter whip antenna of approximately 300 grams. The antenna disclosed herein may be conformable to any geometry.

While this disclosure has focused primarily on polypyrrole, it should be recognized that other conductive polymers such as polyaniline, poly (3, 4-ethylenedioxythiophene), polyacetylene, poly (thiophene)s, etc. may be used.

It is recognized that modifications and variations of the invention disclosed herein will be apparent to those of ordinary skill in the art and it is intended that all such modifications and variations be included within the scope of the appended claims.

What is claimed is:

1. An antenna comprising a wire made of a uniform electrochemically deposited conducting polymer, the wire sewn into a fabric material in a selected pattern, and a coaxial cable connector that is fastened into the fabric material allowing for the wire to be connected to a proximal end of a transmission coaxial cable, wherein the wire is strain relieved within the fabric material to increase the flexibility and maintain the functional capabilities of the antenna.

2. The antenna of claim 1 wherein the conducting polymer is polypyrrole.

3. The antenna of claim 1 wherein the wire is encased in a non-conductive, low dielectric plastic.

4. The antenna of claim 1 wherein the fabric material includes a hook-and-loop portion for attachment to another object.

5. The antenna of claim 4 wherein the object is an article of clothing.

6. The antenna of claim 1, wherein the distal end of the coaxial cable includes a connector for interface with a radio device.

7. The antenna of claim 1 wherein the fabric material is enclosed in a weather-proof casing.

* * * * *